United States Patent [19]

Colliva

[11] Patent Number: 4,686,795

[45] Date of Patent: Aug. 18, 1987

[54] PRINCIPLES AND APPLIANCES FOR CUTTING OF SPHERICAL-FACETED GEMS AND GEMS THUS OBTAINED

[76] Inventor: Giovanni Colliva, Rua Tenente Azevedo, 104 - São Paulo, Brazil

[21] Appl. No.: 829,460

[22] Filed: Feb. 12, 1986

Related U.S. Application Data

[63] Continuation of Ser. No. 527,091, Aug. 29, 1983, abandoned.

[30] Foreign Application Priority Data

Sep. 16, 1982 [IT] Italy ..... 41011 A/82
Aug. 3, 1983 [IT] Italy ..... 22408 A/83

[51] Int. Cl.[4] ..... B24B 13/02

[52] U.S. Cl. ..... 51/125; 51/216 LP; 51/229; 51/284 R; 51/124 L

[58] Field of Search ..... 51/125, 121, 125.5, 51/229, 284 R, 216 LP, DIG. 14, 127–128, 124 L, 122, 283 R, 283 E; 125/30; 269/55

[56] References Cited

U.S. PATENT DOCUMENTS 1,173,175 2/1916 Coleman ..... 51/125
2,450,984 10/1948 Pastore ..... 51/229
2,728,364 12/1955 Muehling ..... 51/128 X
3,169,350 2/1965 Corman ..... 51/127 X
3,559,349 2/1971 Imahashi ..... 51/229
3,624,968 12/1971 Leibowitz ..... 51/229 X
3,886,696 6/1975 Bruck ..... 51/216 LP
3,920,233 11/1975 Stuckert ..... 269/55

FOREIGN PATENT DOCUMENTS 581619 10/1946 United Kingdom .
697804 9/1953 United Kingdom .
1183914 3/1970 United Kingdom .
1393934 5/1975 United Kingdom .
1408648 10/1975 United Kingdom .

*Primary Examiner*—Frederick R. Schmidt
*Assistant Examiner*—Debra S. Meislin

[57] ABSTRACT

An introductory outline expounds the visual effects produced when gems are cut with spherical facets, rather than with the conventionally flat ones. An indication follows of some kinematic principles and devices which enable the manufacture of this type of facet. In particular, sphere-shaped abrasive covers or bowls are foreseen on which will be fixed the gem-carrying terminal of a conventional tripodal faceter whose two other terminals of support are guided in such a way as to make gem carrying terminal (C) describe a sphere, maintaining a constant angle between the axis of the gem and the normal to the abrasive cover at the point of contact.

1 Claim, 17 Drawing Figures

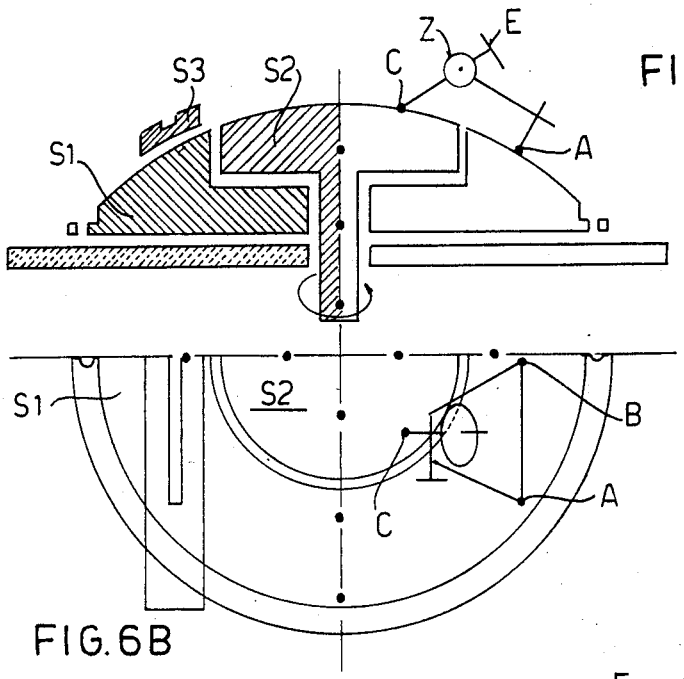
FIG. 6A
FIG. 6B
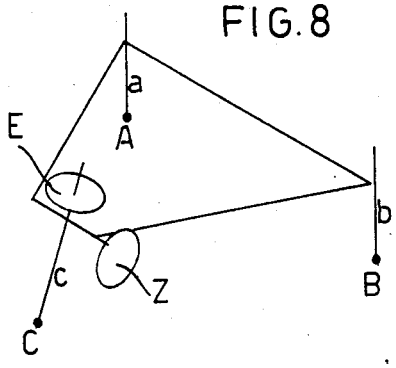
FIG. 8
FIG. 7A
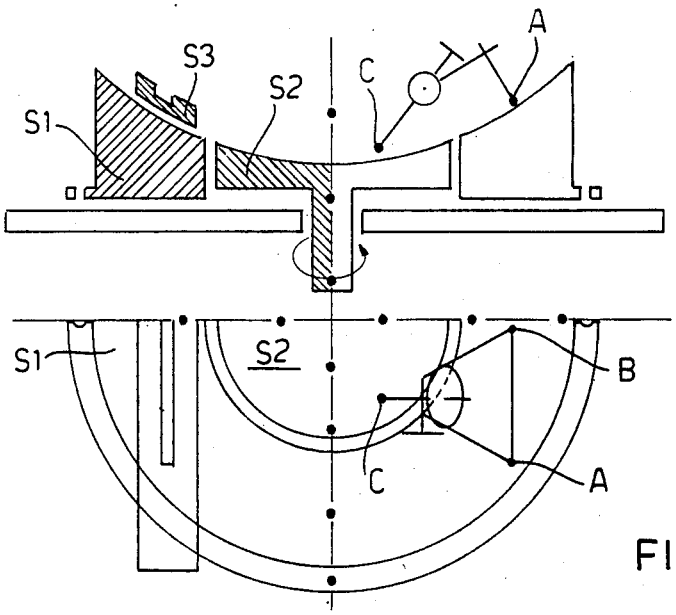
FIG. 7B

FIG. 11
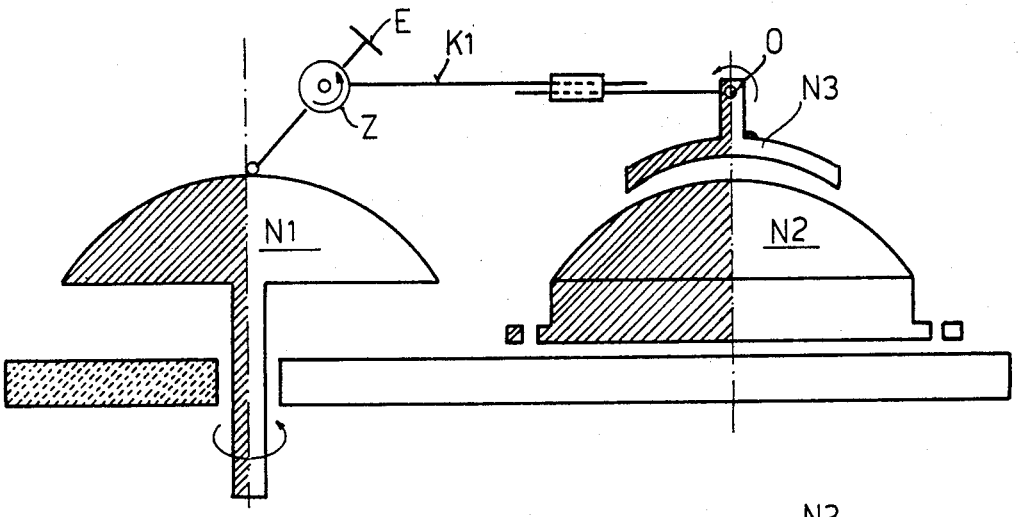
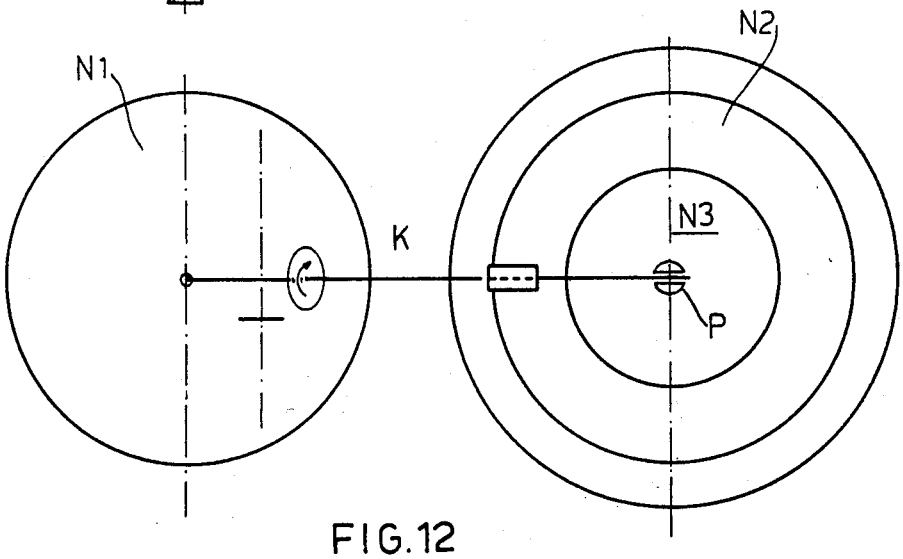
FIG. 12

PRINCIPLES AND APPLIANCES FOR CUTTING OF SPHERICAL-FACETED GEMS AND GEMS THUS OBTAINED

This application is a continuation of application Ser. No. 527,091, filed Aug. 29, 1983, now abandoned.

For centuries, gem lapidation has been carried out by cutting rough crystals with various sets of flat facets, irrespective of the final shape required. With this criterium of construction, a conventionally-cut gem is reduced to an optical system consisting only of prisms and flat reflective surfaces. For a light source, this optical system always produces a virtual image; moreover, given the reduced dimensions of a gem, the image produced is strongly diaphragmed from the stone's structure; which is why it is received by the eye transitorily and intermittently, due to the continuous movements between the light-source, gem and observer. The use of spherical facets, whether they be concave or convex, in the place of traditional ones, transforms the gem into a true and proper catoptric system capable of a greater dispersive effect, producing images closer to the stone which, however, appear more luminous to the observer since they are closer to and less diaphragmed from the stone's structure.

FIGS. 11 and 12 are respectively lateral and above views of another apparatus;

That this catoptric system brings the image of a light-source closer to the physical structure of a gem may be verified by applying the equations below, which link the conjugate points s and s' to a dioptric of radius R, which separates the media having refractive indices n and n' (a) and the conjugate points s and s' with respect to the reflective sphere also of radius R (b), as shown below:

$$\frac{n}{s} + \frac{n1}{s1} = \frac{n^1 - n}{R} \quad \text{(a)}$$

$$\frac{1}{s} - \frac{1}{s^1} = \frac{-2}{R} \quad \text{(b)}$$

In fact, applying the equations (a) and (b) successively to the profiles of FIGS. 1, 2 and 3 in table 1, that is, to gems having, respectively, flat, concave, and convex facets, but with, however, identical shape, weight and refractive index, one obtains the results shown on the synoptic table below:

COMPARATIVE TABLE

Figure 1:
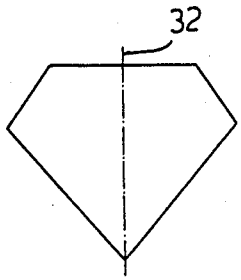
Figure 2:
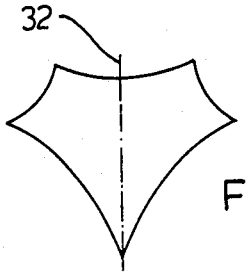
Figure 3:
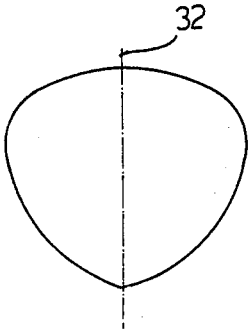
Figure 4:
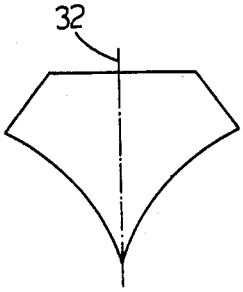

Position of conjugate points with respect to a flat-faceted gem and conjugate points with respect to a spherical faceted gem, as shown in the diagrams of FIGS. 1, 2, 3 for which: n = 1.70 R = 75 cm and the incident light ray is perpendicular to upper part of gem, or "crown".

| Postulates of operation | | Flat-faceted gems | | Concave-faceted gems | | Convex-faceted gems | |
|---|---|---|---|---|---|---|---|
| Distance Gem-Source (cm) | Distance Gem-Eye (cm) | Distance Image-Gem (cm) | Distance Image-Eye (cm) | Distance Image-Gem (cm) | Distance Image-Eye (cm) | Distance Image-Gem (cm) | Distance Image-Eye (cm) |
| 200 | 200 | −200(") | −300(") | 46(") | 54(") | −31(") | 131(") |
| ∞ | 100 | −∞(") | −∞(") | 37(") | 63(") | −37(") | 137(") |
| 200 | 100 | −200 | 300 | −8,7 | 108,7 | 9,5 | 90,4 |
| ∞ | 100 | ∞ | ∞ | −9,1 | 109,1 | 9,1 | 90,9 |

OBSERVATIONS:

1 Distance of images obtained by simplified calculations, using the formula (a) and (b), without considering influence of refractive index or of distance between facets when calculating optical paths.

2 Valves marked by an asterisk (") refer to images produced by reflections on external facets.

3 The sign (+) indicates real images above the gem; the sign (−) indicates virtual images below the gem.

Figure 5:
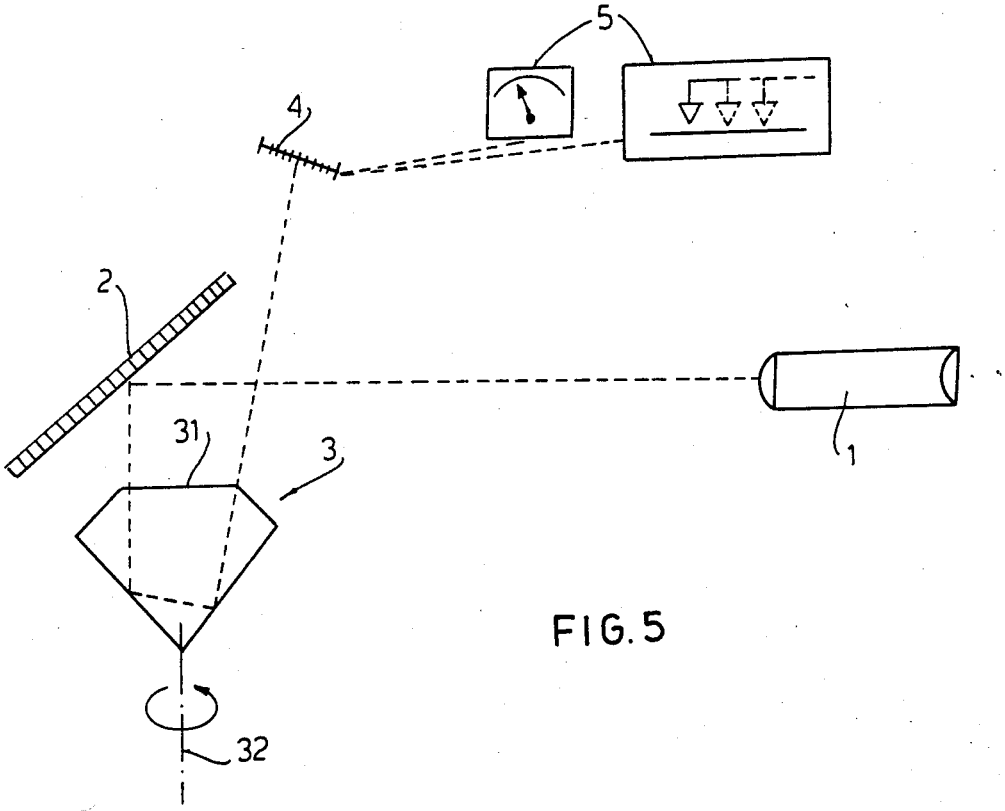
Figure 10:
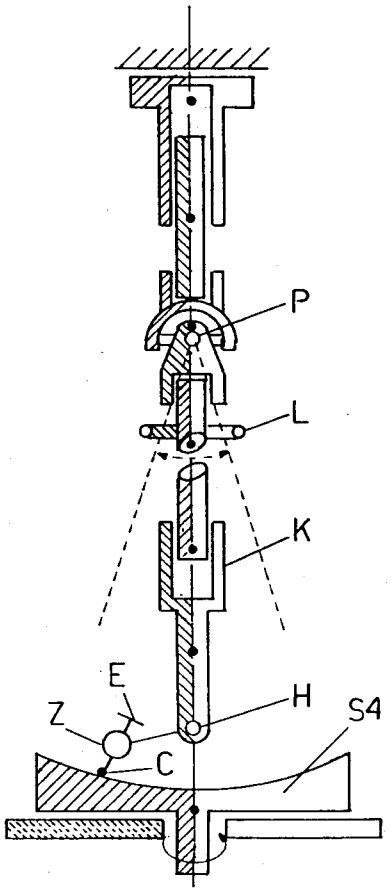
Figure 9B:
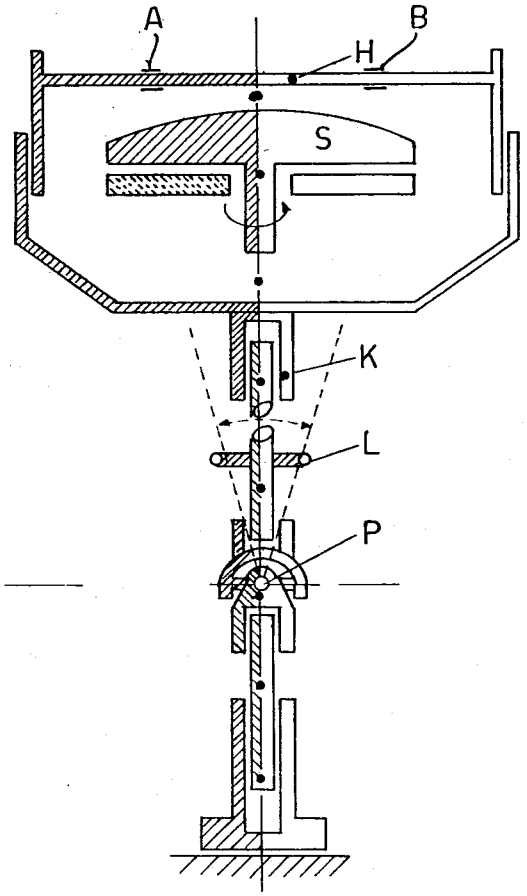
Figure 9A:
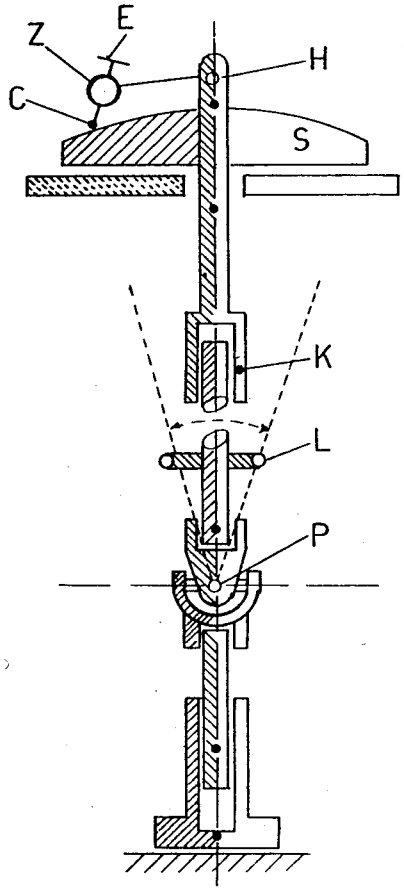

The invention will now be clarified using as examples some embodiments represented by the diagrams attached, in which:

FIGS. 1, 2, 3 and 4 are general views of gems cut respectively in the conventional manner, with concave surfaces, convex surfaces and partially concave ones;

FIG. 5 is a diagram of a fotometric experiment;

FIGS. 6A and 6B each show respectively a first apparatus, sectionally and in a plan, for carrying out the cutting of gems according to the present invention in the case of concave facets;

FIGS. 7A and 7B are analogous to FIGS. 6A and 6B, but they show an apparatus designed for cutting gems with convex surfaces;

FIG. 8 is a diagram of a facetting conventional tripodal utensil;

FIGS. 9A and 9B are lateral views of a different apparatus for the present invention, where one is rotated through 90° with respect to the other;

FIG. 10 is the view of a similar apparatus to the one shown in FIGS. 9A and 9B, but used in the facetting of a gem with convex surfaces;

These data relate to the conditions of use typical in the presentation of a gem. For all the distances provided for by the light-source, the concave-faceted gems always produce virtual images that are very close to the bottom of the stone and, therefore, turn out to be less refracted from the stone's structure. At the same time, they appear as a result even more luminous to the eye of an observer, in that they are closer to the latter.

However, in the case of convex-faceted gems, the real images obtained are not seen by an observer positioned one meter away from the object, because these images are formed in the air, above the stone. In recompense, the same images, as it has been shown in practice, are seen in all their splendour by a distant observer positioned more than 5 meters away from the gem. In fact, at such a distance, the eye of the observer, as it directs itself towards the gem, is already adjusted to an infinite vision, where he will see, superimposed upon the gem's contours, either the image of the source provided by the external surface reflection, or the image produced by a total internal reflection. This is the typical case for a gem displayed on the edge of a box in a theatre, illuminated by ten or so hanging lamps, and which is observed from a distance by spectators standing in other boxes, or in the pit.

At this point, having verified the geometric effects of bringing these images closer, the supposed increase in luminosity of the images caused by the use of spherical facets now remains to be proven and measured, as well as the increase in the quantity of light picked up by the eye of an observer.

Figure 13:
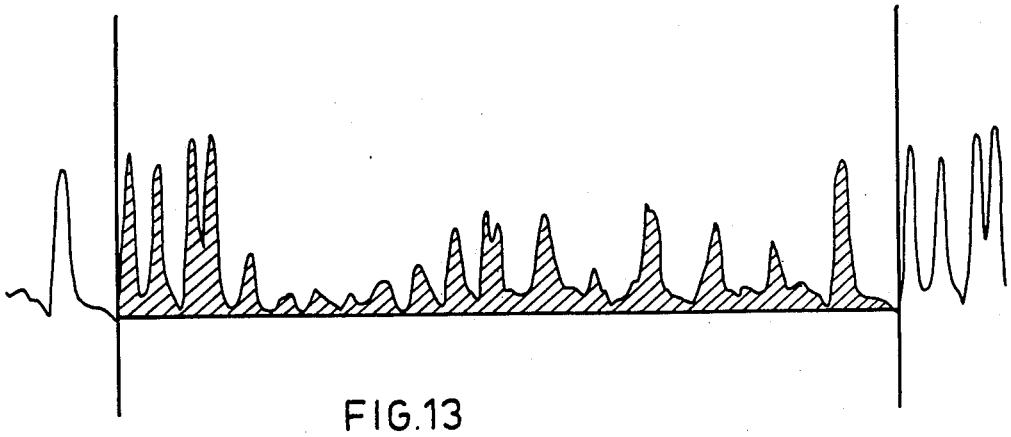
FIGS. 13 and 14 are two graphs showing the luminous efficiency of a gem which is respectively conventional, and with spherical facets.
Figure 14:
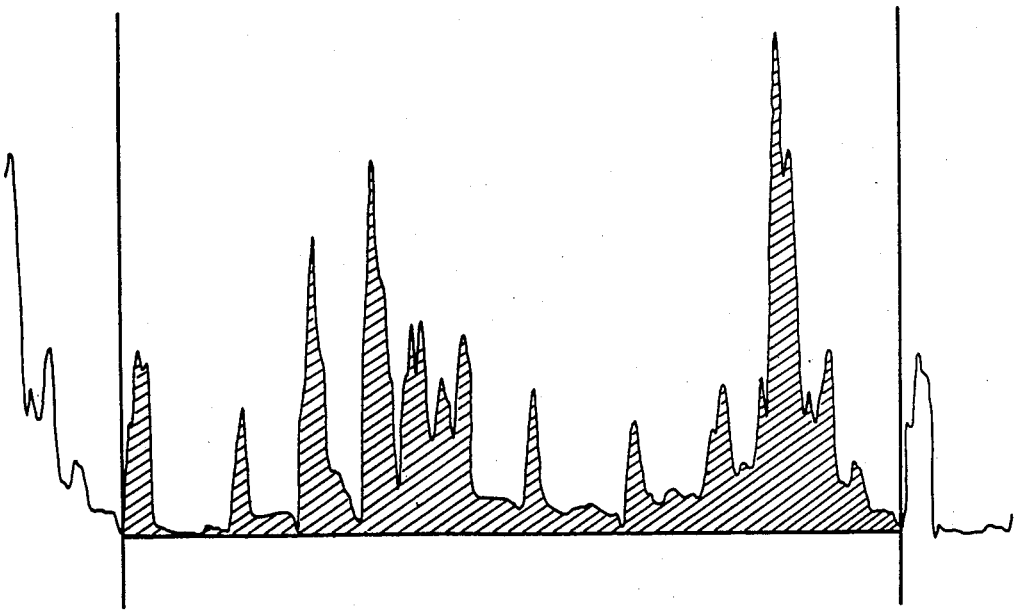

With this aim in mind, photometric tests have also been carried out in the laboratory, according to the diagram in FIG. 5. Here, one sees that the projector lamp I, by means of the silvered mirror 2, sends a beam of light perpendicular to the "table" or flat surface of a gem 3 rotating on its axis of symmetry 32; the flashes of the total reflections sent back from the gem, cut into the photoelectric cell 4, which is positioned obliquely to this axis, at a distance of one meter, which sensitises the recording apparatus 5 with its pulses. Using this photometric apparatus, various series of comparative tests have been carried out in a University Laboratory of a high standard, on two colourless beryls, having identical form and dimensions (approx 20 carats), with flat rectangular tops, and cut like an emerald. One of the gems had conventional flat facets and the other had concave spherical facets. Under identical experimental conditions (intensity of the incident light; number of rotations per minute; distances between light-source-gem-photoelectric cell; speed of slip of recording sheet, etc.) the recording-apparatus has provided the graphs reproduced in FIGS. 13 and 14. These present respectively the impulses caused by the reflections of the flat-faceted gem and those caused by the concave spherical-faceted gem, during rotation on their axes of symmetry 32.

The following notes are towards an interpretation of these graphs:

a—The graphs repeat themselves continually at each full rotation of the gem; a foreseeable fact given that the gem's parameters will always be constant during the tests;

b—The height of the curve peaks indicate the maximum luminosity obtained by each single flash, i.e. by each total reflexion produced by the rotating gem and picked up by the cell;

c—The total surface which is delimited at each rotation by the upper contour of the graph and by the horizontal base-line (see the shaded area on graphs) indicates the total quantity of light reflected from the gem and picked up by the gem during a full rotation;

d—The number of peaks occurring in a cycle indicates the number of flashes, or the number of total reflections occurring in the gem in the course of a full rotation and picked up by the cell.

A simple visual comparison of the two sets of graphs permits one to affirm that, excluding any error of calculation or subjective observation, the use of spherical facets substantially increases the value of all the parameters of the luminous output of a gem, as specified in the paragraphs b-c-d-.

Unfortunately, the photometric tests have not been completed with angle measurements for also determining the dramatic increase of chromatic dispersion as seen by the naked eye. Nonetheless, it seems reasonable to believe that the lenticular effect of the diopters entering and emerging from the gem necessarily constitutes an increase in the lateral chromatic dispersion usually produced by conventional flat-faceted gems. Furthermore, it must be remembered that in a catoptric system constituted by one spherical-faceted gem, an axial component of the chromatic dispersion, inexistent in flat-faceted gems, is also automatically produced, and this superimposes itself upon the component already laterally increased by the diopters; thus a dual strengthening of the so-called "fire" of the gem takes place.

Finally, it should be noted that the progressive reduction of the radius of curvature in a spherical-faceted gem promotes the intensification of the stone's total brilliance in the sense that, as the radius becomes smaller, the image from a light-source, whether real or virtual, gets increasingly closer to the body of the stone; and this effect involves a progressive reduction in the diaphragm-openings of the reflected light-beams, benefitting the eventual optical output. Of course, this faculty should not be exaggerated, otherwise the external appearance of the gem might become too different from that of the traditioned gem, with possible counter-productive effects on commercialization. All that remains to be said is that as one lowers the carat of the gem, one may have accordingly decreasing radii of curvature, since the gradual reduction of the facets, which will be accompanied by a decrease in the gem's dimensions, results naturally in a spherical ball of progressively smaller camber and gradually less-accentuated edges. Evidently, only practice will establish what the minimum radius of curvature is to fit best the dimensions of a given stone. From these introductory notes the following may be concluded:

1—That the adoption of spherical facets actually increases all the factors of brilliance (external and internal brilliance; brilliancy of the sparkle, and brilliancy of dispersion), all of which contribute to the total brilliancy of the gem;

2—That the concave facets are suitable for gems intended to be viewed by close observers;

3—That the convex facets are recommended only for gems intended to be viewed mainly by distant observers;

4—That as a stone's dimensions decrease, the radius of curvature of the spherical facets may also be decreased, thus improving the luminous efficiency of the catoptric system.

It is possible to produce gems with flat facets in the upper part or "crown", and spherical facets in the lower part, or "pavillon". This system may be adopted when one wishes to conceal the use of spherical facets, thus deliberately cutting out a part of the obtainable increase in brilliance. It is also possible to produce gems which possess at once concave, convex and flat facets, placed together in a group, or in alternation, in both the "crown" and the "pavillon", or just in the "pavillon". Also foreseen are gems principally intended to obtain new optico-ornamental effects, which may be contemplated by either distant or close observers, even if this results in fewer flashes being observed, for a given movement relative to the gem-light-source-observer. In fact, close observers will see the total reflections produced by the concave facets of the "pavillon"; whereas distant observers will only see those produced by the convex facets. The notes which follow describe the kinematic principles which determine the cut of a spherical-faceted gem, and a basic apparatus for this process. However, for a better understanding of this, it is worth a brief reminder of what the essential process for the preparation of a normal flat facet is. Briefly, this process involves rubbing the uncut stone against a rotating disc, normally of metal, so that the wearing-down resulting from the interference between the appropriate abrasives, conveniently scaled-down in their dimensions, will give, as a result, the dimensions and angles required for the facets being processed, throughout the successive phases of rough-shaping, lapping and polishing. With the manufacture of spherical facets, the whole process is identical, but, obviously, the phases of rough-shaping, lapping and polishing must be carried out by rubbing the rough stone on a sphere-shaped cover, or bowl, rather than on a flat disc.

The apparatus drawn in FIGS. 6A, 6B and 7A, 7B enables this aim to be realized, respectively for the production of concave spherical surfaces FIGS. 6A, 6B or convex ones FIGS. 7A, 7B. Both diagrams are characterised in that they constitute two contiguous, coaxial and concentric covers or bowls each having a sphere-shaped surface, with the same radius of curvature; the central one is rotating and the abrasion necessary for the production of the facet occurs on it; the second outermost one is fixed and serves as a surface to support two of the three support points of a conventional gem-holding fixture (this fixture will be referred to as the "faceter" that supports the gem in a gem lappidation apparatus from now on, for purposes of brevity). The faceter may consist, for example, of the P type faceter manufactured by firm Imahashi MFG. Co., Ltd, Tokyo, Japan. During the operation, the two points of support in the faceter, A and B, remain throughout in the external supporting sphere-shaped surface of the cover or bowl, S1, while the third C, which is the gem, will be placed in contact with the internal rotating cap S2, which contains the appropriate abrasives. One may observe that for all the possible variable positions given to the faceter, either in the search for a better direction of abrasion, or in order to place the stone in a zone of the most suitable velocity for this abrasive process, the three ends of the faceter will always lay on the sphere-shaped surfaces of the respective supporting covers or bowls. More importantly, the facet which is to be formed will have the same curvature as the abrasive cap, whilst the initial angle with respect to the perpendicular of the contact point will remain practically constant until the desired dimension for the facet in process is obtained. What follows will be the known re-iteration of the operations seen now for all facets required from the selected cut, and this will be carried out with the help of goniometers, which are provided on the faceter an which are represented by the diagrams in FIG. 8. Goniometer E causes the gem to rotate about its own axis 32; this rotation then brings the certain sections of the various facets into contact with the cutting-edge; goniometer Z causes the gem to rotate about an axis perpendicular to the axis 32 of the gem and it serves to give to the same section of a whole set of facets the angle which they require for the shape of the gem.

This apparatus may be provided with a sector member S3 having a rectangular periphery edge and a spherical bottom portion of the same radius of curvature as the other covers S1 and S2 on which it may slide freely in all directions. The sector S3 has a longitudinal spline for supporting terminals A and B of a conventional faceter. The conventional faceter, with fulcrums The faceter, with fulcrum at A and B, is free to rotate about the axis of the spline until it allows contact between the gem-carrying terminal C with the abrasive cover S2. It is clear that in this kinematic arrangement, the gem-carrying terminal C will always move on the sphere to which the covers SI and S2 belong, maintaining the initial angle which it is given with respect to these constant. The advantage of this accessory is that it allows the gem being processed larger and more varied displacements upon the abrasive cover S2, without the already cumbersome cover S1 having to be increased in size for this purpose, nor with the distance between the terminals A and B having to be altered. Of course, in order to avoid abrasion on the surface of contact of S3, the rotating abrasive sphere-shaped working surface of the cover S2 will have to be lowered by about one tenth of a millimeter with respect to the to the sphere-shaped support surface of fixed cover SI, and thus, the radius of curvature of the sphere-shaped working surface; is reduced accordingly.

FIGS. 9A and 9B 6 represent an application of these principles. In these, the support terminals A and B, rather than leaning against the fixed cover S1 of FIG. 1—are coupled with a shaft H which closes a forked arm K, pivoted on P, by means of a universal joint; the point P is the centre of the sphere to which the abrasive sphere-shaped cover S belongs, the latter's axis of rotation also passes through this centre. The faceter, which has its terminals of support A and B fixed on the shaft H in a position symmetrical to the geometric centre of H, pulled by the oscillations of its terminal C will therefore always move tangentially to a sphere of centre P constructed with the same centre as the abrasive "cover". By causing the terminals A and B to rotate around H, one will be able to bring the gem-holding terminal C into contact with the abrasive "cover" S and the angle of this with respect to the vertical of the point of contact will remain constant whatever the movement imposed on the oscillating arm K. The use of an apparatus constructed thus offers the following advantages:

(1) The elimination of a heavy and voluminous fixed cover or bowl S2 from the apparatus illustrated in the diagrams in FIGS. 6A, 6B, 7A, 7B.

(2) Possibility of varying the curvature of the facets by adjusting the length and position of the oscillating arm K, and substituting the one abrasive cover or bowl having a sphere-shaped surface with another having the desired radius of curvature.

(3) Possibility of producing convex-faceted gems by vertically suspending the oscillating arm K above a concave abrasive sphere-shaped surface of a cover or bowl. (see FIG. 10).

(4) Possibility of setting up the apparatus horizontally so as to permit a better view of the operation, a particularly useful position in the case of a re-lapidation of a previously cut stone, or of one that has been cut faultily.

(5) Possibility of limiting the displacements of the stone upon the cover or bowl, in order to prevent the stone from falling off the edge of the cover, by simple adjusting of the position of ring L.

(6) Possibility of mechanizing the displacements of the stone processed, by acting on the oscillating arm K with conventional automatic artifices (eccentrically rotating pivots etc.).

The FIGS. 11 and 12 illustrate another apparatus for obtaining the cut of spherical facets, respecting the basic need to keep the angle of the stone being processed constant with respect to the sphere-shaped surface of the cover or bowl, for whatever translation imposed on the gem-carrying arm. This involves a mechanical device constituting 3 sphere-shaped covers or bowls NI, N2, and N3 with a sphere-shaped surface, of equal radius of curvature; NI is the rotating abrasive sphere; N2 is the sphere of identical dimensions and coplanar to NI, but fixed, serving as a support to the oscillating cover N3 on which a gem-holding arm KI is inserted, provided with conventional goniometers E and Z and free to rotate about a pivot O, lying in a single meridian of N3. With this device one may verify that, placing O on the axis of S3 and giving arm KI a length equal to the distance between the axes of NI and N2, the gem will be able to settle on the sphere-shaped surface of the abrasive cover, or bowl, maintaining the initial angle received at a constant, irrespective of the position or movement of N3 on N2: a requirement which, as has been stated, is indispensable for the cutting of a spherical facet of predetermined angle with respect to the axis of symmetry of the gem.

What we claim is:

1. Apparatus for lapping a gem to form spherical facets thereon, said apparatus comprising a rotatable abrasive lapping tool having a sphere-shaped working surface, gem holding means for holding a gem in contact with said sphere-shaped working surface of said lapping tool, a fixed support member having an annular sphere-shaped support surface surrounding and coaxial with said tool for supporting said gem holding means, the radii of said sphere-shaped working surface of said lapping tool and of said sphere-shaped support surface of said support member being finite and substantially equal, and guide means movable over and in contact with said sphere-shaped support surface, said guide means being rigidly connected to said gem holding means to move said gem holding means over said lapping tool in such an orientation that a spherical facet in contact with the tool will always have a common center with the sphere-shaped working surface of the tool, said guide means movably contacting said support surface at only two spaced points.

* * * * *